US006226814B1

(12) United States Patent
Alexander

(10) Patent No.: US 6,226,814 B1
(45) Date of Patent: May 8, 2001

(54) SEPARABLE BED COVERING

(76) Inventor: Brenda G. Alexander, N. Park St., East Orange, NJ (US) 07017

( * ) Notice: Subject to any disclaimer, the term of this patent is extended or adjusted under 35 U.S.C. 154(b) by 0 days.

(21) Appl. No.: 09/667,463

(22) Filed: Sep. 22, 2000

Related U.S. Application Data

(60) Provisional application No. 60/156,618, filed on Sep. 29, 1999.

(51) Int. Cl.[7] ..... A47G 9/04
(52) U.S. Cl. ..... 5/486; 5/923
(58) Field of Search ..... 5/486, 482, 923, 5/502, 417, 413 R, 496, 498

(56) References Cited

U.S. PATENT DOCUMENTS 1,267,042 * 5/1918 Arnold ..... 5/486
2,689,961 * 9/1954 Lieberthal ..... 5/486
3,072,776 * 1/1963 Quenneville ..... 5/486
4,573,227 * 3/1986 Prandina ..... 5/486
5,943,717 * 8/1999 Alexander ..... 5/482

* cited by examiner

*Primary Examiner*—Alexander Grosz
(74) *Attorney, Agent, or Firm*—Goldstein & Canino

(57) ABSTRACT

A separable bed covering including a pair of rectangular sheets each having a short upper edge, a short lower edge, a long inner edge, and a long outer edge. The long inner edge of a first sheet has a hook and loop strip extending therealong on a bottom surface thereof. The long inner edge of a second sheet has a hook and loop strip extending therealong on a top surface thereof for mating with the hook and loop strip of the first sheet to form a single large sheet. A supplemental sheet connects the first sheet to the second sheet. The supplemental sheet has a first edge fixedly secured to the long inner edge of the first sheet. A second edge of the supplemental sheet has a hook and loop strip disposed thereon for mating with a second hook and loop strip on a central portion of the second sheet.

1 Claim, 2 Drawing Sheets

SEPARABLE BED COVERING

CROSS REFERENCES AND RELATED SUBJECT MATTER

This application relates to subject matter contained in provisional patent application Ser. No. 60/156,618, filed in the United States Patent & Trademark Office on Sep. 29, 1999.

BACKGROUND OF THE INVENTION

The present invention relates to a separable bed covering and more particularly pertains to allowing for separation of a single covering into two coverings.

One of the problems with sharing a bed with another person is the constant battle that takes place for the proper amount of blanket covering that each occupant desires. What is needed is a bed covering that will allow for each occupant of the bed to have the proper amount of covering that they require.

The present invention attempts to solve the abovementioned problem by providing a single bed covering that includes a pair of separable sections that can be completely detached from one another to provide two people sharing bed to have their own covering.

The use of bed sheets is known in the prior art. More specifically, bed sheets heretofore devised and utilized for the purpose of providing warmth to people in bed are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,072,776 to Quenneville discloses a set of overlapping bed covers for plural occupants, to prevent pulling the blanket to one side of the bed. U.S. Pat. No. 4,005,499 to Klein discloses an individual bed covering with two separate halves suited for use by two people. U.S. Pat. No. 5,287,573 to Ritacco discloses a divided bed sheet for two people with different heat capacities for each side. U.S. Pat. No. 5,005,235 to Huang and U.S. Pat. No. 4,183,111 to Zahavkochav each disclose two person sleeping bags.

While these devices fulfill their respective, particular objective and requirements, the aforementioned patents do not describe a separable bed covering for allowing for separation of a single covering into two coverings.

In this respect, the separable bed covering according to the present invention substantially departs from the conventional concepts and designs of the prior art, and in doing so provides an apparatus primarily developed for the purpose of allowing for separation of a single covering into two coverings.

Therefore, it can be appreciated that there exists a continuing need for a new and improved separable bed covering which can be used for allowing for separation of a single covering into two coverings. In this regard, the present invention substantially fulfills this need.

SUMMARY OF THE INVENTION

In the view of the foregoing disadvantages inherent in the known types of bed sheets now present in the prior art, the present invention provides an improved separable bed covering. As such, the general purpose of the present invention, which will be described subsequently in greater detail, is to provide a new and improved separable bed covering and method which has all the advantages of the prior art and none of the disadvantages.

To attain this, the present invention essentially comprises a pair of rectangular sheets each having a short upper edge, a short lower edge, a long inner edge, and a long outer edge. The long inner edge of a first sheet has a hook and loop strip extending therealong on a bottom surface thereof. The long inner edge of a second sheet has a hook and loop strip extending therealong on a top surface thereof for mating with the hook and loop strip of the first sheet to form a single large sheet. A supplemental sheet connects the first sheet to the second sheet. The supplemental sheet has a first edge fixedly secured to the long inner edge of the first sheet. A second edge of the supplemental sheet has a hook and loop strip disposed thereon for mating with a second hook and loop strip on a central portion of the second sheet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced it and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved separable bed covering which has all the advantages of the prior art bed sheets and none of the disadvantages.

It is another object of the present invention to provide a new and improved separable bed covering which may be easily and efficiently manufactured and marketed.

It is a further object of the present invention to provide a new and improved separable bed covering which is of durable and reliable construction.

An even further object of the present invention is to provide a new and improved separable bed covering which is susceptible of a low cost of manufacture with regard to both materials and labor, and which accordingly is then susceptible of low prices of sale to the consuming public, thereby making such a separable bed covering economically available to the buying public.

Even still another object of the present invention is to provide a new and improved separable bed covering for allowing for separation of a single covering into two coverings.

Lastly, it is an object of the present invention to provide a new and improved separable bed covering including a pair of rectangular sheets each having a short upper edge, a short lower edge, a long inner edge, and a long outer edge. The long inner edge of a first sheet has a hook and loop strip extending therealong on a bottom surface thereof. The long inner edge of a second sheet has a hook and loop strip extending therealong on a top surface thereof for mating with the hook and loop strip of the first sheet to form a single large sheet. A supplemental sheet connects the first sheet to the second sheet. The supplemental sheet has a first edge fixedly secured to the long inner edge of the first sheet. A second edge of the supplemental sheet has a hook and loop strip disposed thereon for mating with a second hook and loop strip on a central portion of the second sheet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
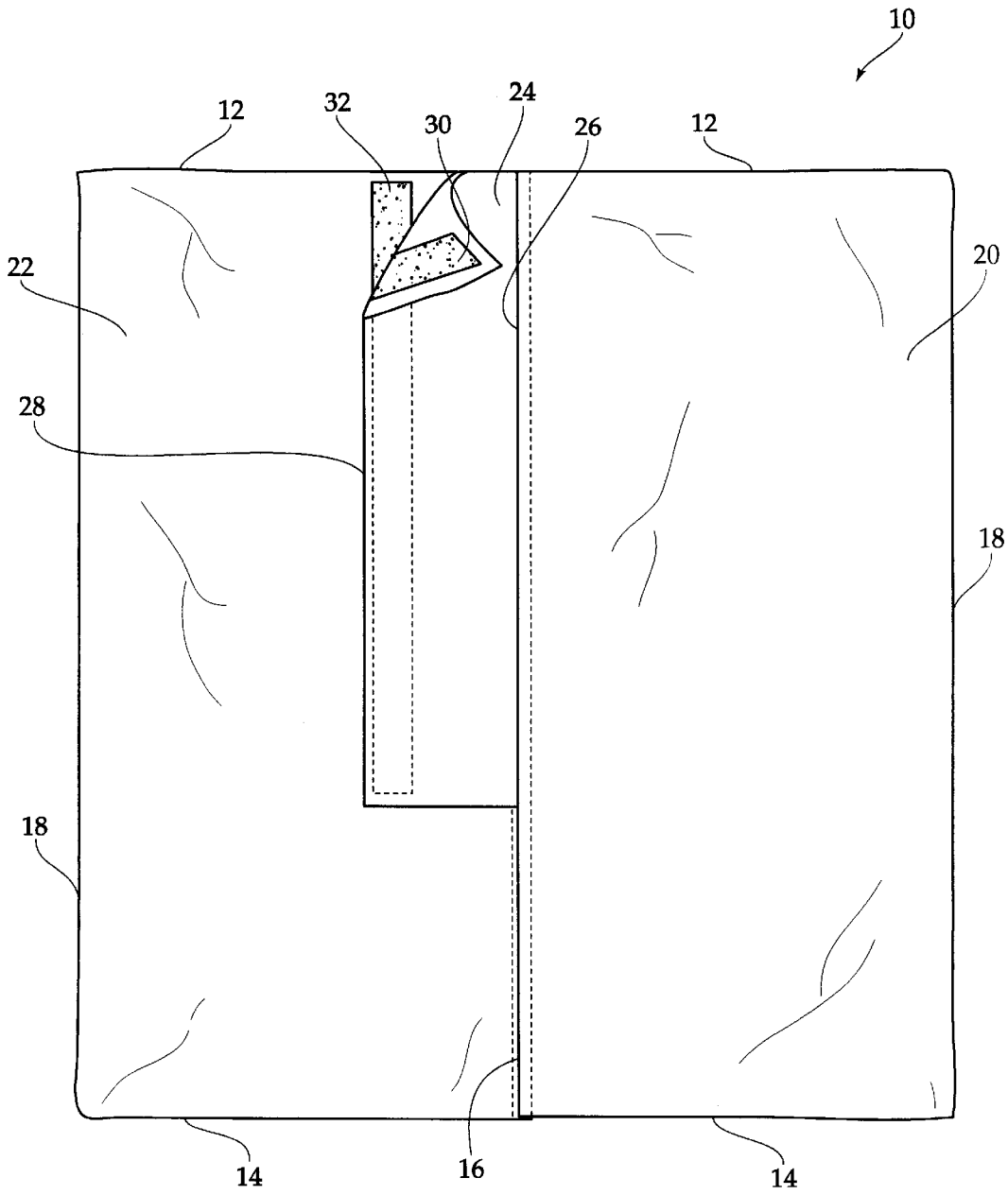
FIG. 1 is a plan view of the preferred embodiment of the separable bed covering constructed in accordance with the principles of the present invention.
Figure 2:
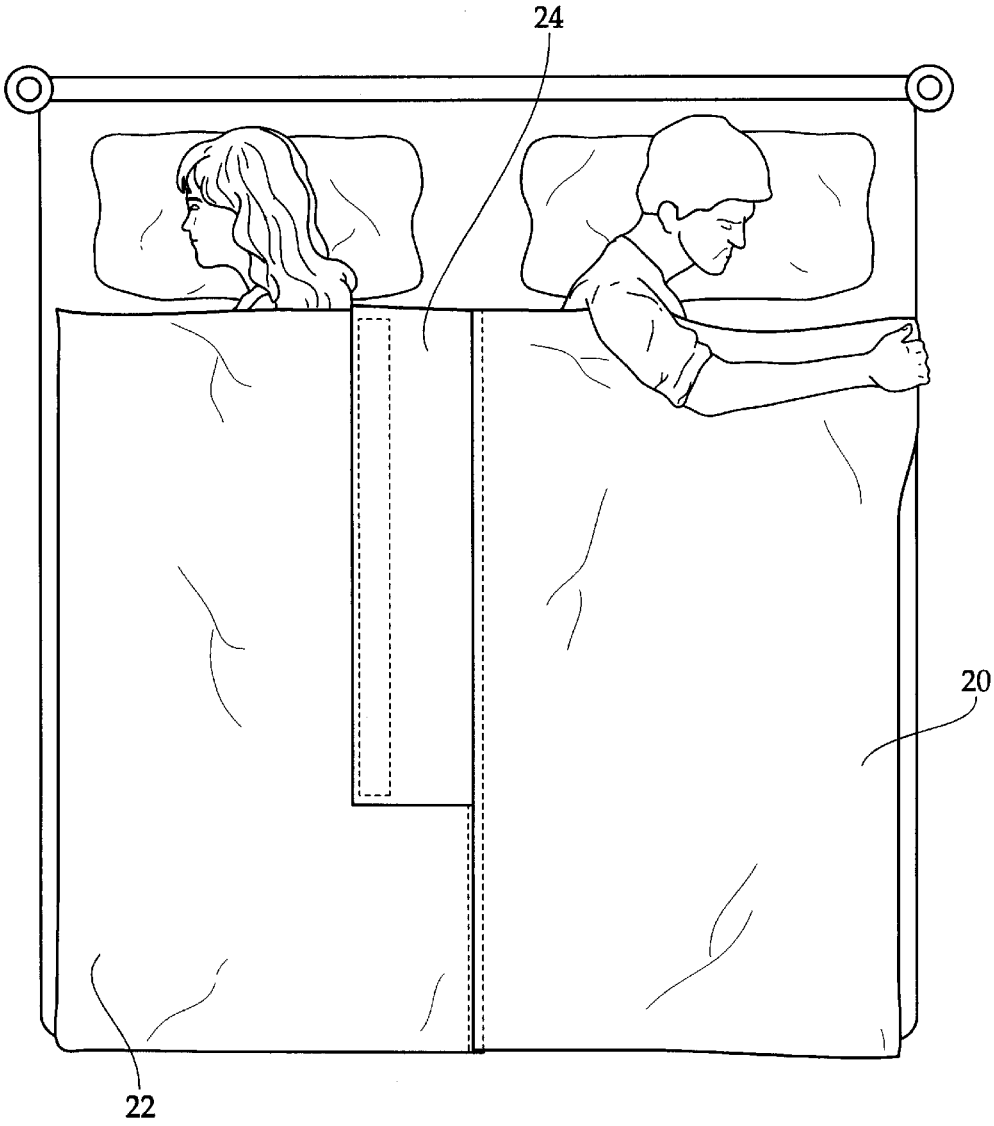
FIG. 2 is a top plan view of the present invention illustrated in use.

With reference now to the drawings, and in particular, to FIGS. 1 and 2 thereof, the preferred embodiment of the new and improved separable bed covering embodying the principles and concepts of the present invention and generally designated by the reference number 10 will be described.

Specifically, it will be noted in the various Figures that the device relates to a separable bed covering for allowing for separation of a single covering into two coverings. In its broadest context, the device consists of a pair of rectangular sheets and a supplemental sheet. Such components are individually configured and correlated with respect to each other so as to attain the desired objective.

The pair of rectangular sheets each have a short upper edge 12, a short lower edge 14, a long inner edge 16, and a long outer edge 18. The long inner edge 16 of a first sheet 20 has a hook and loop strip extending therealong on a bottom surface thereof. The long inner edge 16 of a second sheet 22 has a hook and loop strip extending therealong on a top surface thereof for mating with the hook and loop strip of the first sheet 20 to form a single large sheet. The first sheet 20 can be detached from the second sheet 22 so as create two individual coverings.

The supplemental sheet 24 connects the first sheet 20 to the second sheet 22. The supplemental sheet 24 has a first edge 26 fixedly secured to the long inner edge 16 of the first sheet 20. A second edge 28 of the supplemental sheet 24 has a hook and loop strip 30 disposed thereon for mating with a second hook and loop strip 32 on a central portion of the second sheet 22. The supplemental sheet 24 will help promote a secure coupling between the first sheet 20 and the second sheet 22 as well as provide an additional layer for the first sheet 20 when the first sheet 20 and the second sheet 22 are separated from one another.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A separable bed covering for allowing for separation of a single covering into two coverings comprising, in combination:

a pair of rectangular sheets each having a short upper edge, a short lower edge, a long inner edge, and a long outer edge, the long inner edge of a first sheet having a hook and loop strip extending therealong on a bottom surface thereof, the long inner edge of a second sheet having a hook and loop strip extending therealong on a top surface thereof for mating with the hook and loop strip of the first sheet to form a single large sheet;

a supplemental sheet connecting the first sheet to the second sheet, the supplemental sheet having a first edge fixedly secured to the long inner edge of the first sheet, a second edge of the supplemental sheet having a hook and loop strips disposed thereon for mating with a second hook and loop strip on a central portion of the second sheet.

* * * * *